US007282645B2

(12) United States Patent
Locke

(10) Patent No.: US 7,282,645 B2
(45) Date of Patent: Oct. 16, 2007

(54) MODULAR INTERCONNECTIVITY SYSTEM AND METHOD

(75) Inventor: Gary J. Locke, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/417,358

(22) Filed: Apr. 16, 2003

(65) Prior Publication Data

US 2004/0206541 A1 Oct. 21, 2004

Related U.S. Application Data

(60) Provisional application No. 60/391,531, filed on Jun. 25, 2002.

(51) Int. Cl.
*H01B 3/00* (2006.01)

(52) U.S. Cl. ..... 174/100; 174/101; 174/68.3; 174/72 A; 174/502; 174/503; 174/68.1; 439/502; 439/503

(58) Field of Classification Search ..... 174/100, 174/101, 68.1, 68.3, 72 A; 439/502, 503
See application file for complete search history.

(56) References Cited

U.S. PATENT DOCUMENTS

| | | | | |
|---|---|---|---|---|
| 2,979,624 | A | 4/1961 | Askerneese | |
| 3,416,001 | A | 12/1968 | Fistell | |
| 3,801,768 | A * | 4/1974 | Meyer | 200/253.1 |
| 3,848,097 | A | 11/1974 | Tucker | |
| 4,188,670 | A * | 2/1980 | Hsia | 365/49 |
| 4,470,656 | A | 9/1984 | Moser et al. | |
| 4,743,999 | A | 5/1988 | Hames | |
| 4,993,970 | A | 2/1991 | Littrell | |
| 5,072,071 | A * | 12/1991 | Cassity et al. | 174/65 R |
| 5,117,122 | A | 5/1992 | Hogarth et al. | |
| 5,340,326 | A | 8/1994 | LeMaster | |
| 5,354,953 | A | 10/1994 | Nattel et al. | |
| 5,359,540 | A | 10/1994 | Ortiz | |
| 5,418,328 | A | 5/1995 | Nadeau | |
| 5,466,165 | A | 11/1995 | Boesel et al. | |
| 5,506,790 | A | 4/1996 | Nguyen | |
| 5,528,477 | A | 6/1996 | Carmo | |
| 5,900,804 | A | 5/1999 | Yewell | |
| 5,984,728 | A | 11/1999 | Chen et al. | |
| 6,004,157 | A | 12/1999 | Glass | |
| 6,200,159 | B1 | 3/2001 | Chou | |
| 6,433,672 | B1 | 8/2002 | Shirmard | |
| 6,445,087 | B1 | 9/2002 | Wang et al. | |
| 2002/0037662 | A1 | 3/2002 | Lee | |

* cited by examiner

*Primary Examiner*—Jinhee Lee
(74) *Attorney, Agent, or Firm*—Tarolli, Sundheim, Covell & Tummino LLP

(57) ABSTRACT

A system in accordance with the present invention interconnects a plurality of devices for electrical power, control, signal, and data transmission. The system includes a single source of components providing complete interconnectivity between a first number of devices. The single source of components provides complete interconnectivity between the first number of devices and a second number of devices augmenting the first number of devices.

5 Claims, 6 Drawing Sheets

MODULAR INTERCONNECTIVITY SYSTEM AND METHOD

REFERENCE TO A PRIOR APPLICATION

This application claims the benefit of U.S. Provisional Application No. 60/391,531, filed Jun. 25, 2002.

TECHNICAL FIELD

The present invention relates to an interconnectivity system and, more particularly, to a modular interconnectivity system, apparatus, and method.

BACKGROUND OF THE INVENTION

Interconnectivity of electrical system components is typically accomplished using conventional wiring methods identified in marketplace standards. Each conventional wiring method constitutes an interconnectivity system that has evolved over years, decades, and in some cases through centuries. None of these interconnectivity system technologies are a "single provider solution". These technologies, because of their evolutionary nature, rely on multiple point source technology providers in the following areas of: system performance criteria and specification; system design test and validation; system implementation methodology; component performance criteria and materials specification; component test and validation; component manufacture and quality assurance; component logistics; system implementation tools; system implementation technical skill; and system installation verification and validation.

This list of providers flows out a series of interconnectivity related technology needs in a logical order. For the conventional interconnectivity system, however, the marketplace provides for these needs in a disjointed, incomplete, and slow moving fashion. This marketplace tendency leaves implementers of interconnectivity systems stuck in time with outmoded and complex technology, coupled with a very high degree of relative cost—all through the auspices of an undocumented and undefined system.

The conventional interdependent interconnectivity solution technologies—at all levels within a system—have multiple sources of supply, which in turn makes each such source in that marketplace a commodity provider with unpredictable commodity margins. A conventional commodity "pipe and wire" interconnectivity solution (of which there are many) follows, specifying the interconnectivity related technology areas.

Pipe and wire solutions evolved out of the electrification of gas lamps where interconnectivity was affected by manually fishing rubber and cotton insulated conductors through the existing gas pipes. From a system engineering perspective, no system level performance criteria or specifications were established. Performance criteria and specifications evolved from multiple arenas and forums.

As no system level performance criteria or specifications been established system design test and validation could only evolve piecemeal "in the field" as the interconnectivity system evolved. Property damage, injury, and loss of life at multiple point implementations were the interconnectivity system's test and validation laboratory.

Implementation methodology also evolved in the field as the routing of existing gas piping evolved into wiring that used directed purpose installation of "electrical conduit". Methods of multiple point sources that mitigated fire damage, and enhanced safety, percolated into a standardized system of interconnectivity practices over decades.

As the pipe and wire interconnectivity methodology evolved, the divergent components from multi-point sources each acquired performance criteria and materials specification as a result of the need to further mitigate fire damage and enhanced safety. These performance criteria and material specifications evolved haphazardly over decades, and continue to be debated today.

Multiple point sources of technology are required to create a complete and viable conventional interconnectivity installation. Therefore, all of the components used in an implementation must typically be manufactured to comply with specific safety standards. (Often, a safety standard is created in order to create a good fit for a specific technology). In order to verify the suitability of the components relative to it's intended implementation, it must typically be evaluated against a safety standard and certified as compliant by a third party testing laboratory (e.g., Underwriters Laboratories, etc.). The components typically bear a certification mark indicating that compliance.

Each pipe and wire system requires multiple point sources of installable components that include: conduit and fittings, work boxes and enclosures, mechanical fasteners and structural supports, compatible wiring devices and electrical equipment, wire, connectors, and terminators. Component quality assurance is as inconsistent as there are multiple point sources of manufacture.

Components for the pipe and wire interconnectivity solution have conventionally been manufactured by divergent sources that are brought together and marketed through electrical supply houses. The supply houses, in this case, provide a necessary service, but also add a significant layer of cost.

Further, limited design tools for pipe and wire interconnectivity solutions are available in the marketplace. All such tools require a high-level skill set in order to implement.

The physical implementation of the certified components must be accomplished using a series of tools that are only available from multiple point sources. Those tools include: common hand tools, specialty hand tools (e.g., test equipment, fish tape, etc.), common power tools, specialty power tools (e.g., cable puller, pipe benders, etc.), common consumables, and specialty consumables (e.g., wire pulling soap, vinyl tape, etc.).

The certified components must be designed into, and installed on, an application specific system with the plethora of necessary tools on a case-by-case basis. From design through installation, a single implementation must be addressed by a series of multiple high-level skill sets that are created from multiple point educational sources. Those sources may include: universities (Masters, Bachelors of Science, etc.), technical colleges (Associates of Science), technical schools (High School Diplomas, equivalency certificates, etc.), military schools (with subsequent practical experience), apprenticeship training programs, state certifications (Professional Engineer), state, county or municipality certifications (Electrical Licensing), continuing education credits, seminars, and/or trade show technical sessions.

These high-level skill sets must utilize a series of technical resource materials that are, furthermore, only available from separate multiple point sources of varying quality. Those technical resource materials may include: limited scope manufacturers bulletins, limited scope "how to" guides, broad scope generic method handbooks, and limited and broad scope informative articles in trade publications. The certified components must be implemented by the high-level skill sets using tools and technical resource materials in accordance with the provisions of the applicable electrical codes.

As the conventional interconnectivity solution is the result of a disjointed and slow evolutionary progression, no high level or thorough system engineering disciplines have been applied. Therefore, organizations like the National Fire Protection Association (NFPA) and the International Electro-technical Commission (IEC) step in to back fill the solution with some systems level "glue" to hold all of the pieces together. Such "glue" is a comprehensive application criteria (that is as detailed as is required) in the form of electrical code requirements. In the interest of the public safety, the electrical code is often adopted as general law and is enforced by government agencies. If the electrical code is not adopted as general law, then private enterprise, agencies, or groups, provide enforcement. The technical capabilities of the enforcement officials vary greatly from location to location and therefore constitute an additional multiple point engagement source for system implementation.

Enforcement officials may be inclusive of: municipal, county, or state agencies; federal departments or administrations; union offices, facility owners, independent investigators, and insurance companies. Presumably, more complicated, unwieldy, unsafe, and uneconomical approaches to bringing an interconnectivity solution to the end user could not be created by design.

SUMMARY OF THE INVENTION

A system in accordance with the present invention interconnects a plurality of devices for electrical power, control, signal, and data transmission. The system includes a single source of components providing complete interconnectivity between a first number of devices. The single source of components provides complete interconnectivity between the first number of devices and a second number of devices augmenting the first number of devices.

A method in accordance with the present invention interconnects a plurality of devices for electrical power, control, signal, and data transmission. The method comprising the steps of: providing complete interconnectivity between a first number of devices by a single source of components; augmenting the first number of devices with a second number of devices; and providing complete interconnectivity between the first number of devices and a second number of devices with the single source of components.

BRIEF DESCRIPTION OF THE DRAWINGS

The foregoing and other advantages of the invention will become more readily apparent from the following description of a preferred embodiment of the invention as taken in conjunction with the accompanying drawings, which are a part hereof, and wherein.

DESCRIPTION OF AN EXAMPLE EMBODIMENT

A system in accordance with the present invention system allows a single point source for all aspects of an interconnectivity solution. This becomes evident in the following review of the system relative to the conventional "pipe and wire" solution, as described above.

FIGS. 1-6 show four example topologies for a system in accordance with the present invention. The interconnectivity illustrated in these four figures may be accomplished from a single source 10 of components in accordance with the present invention. Complete electrical power, electronic control, electronic signal, and electronic data transmission may be provided by the single source 10.

Figure 1:
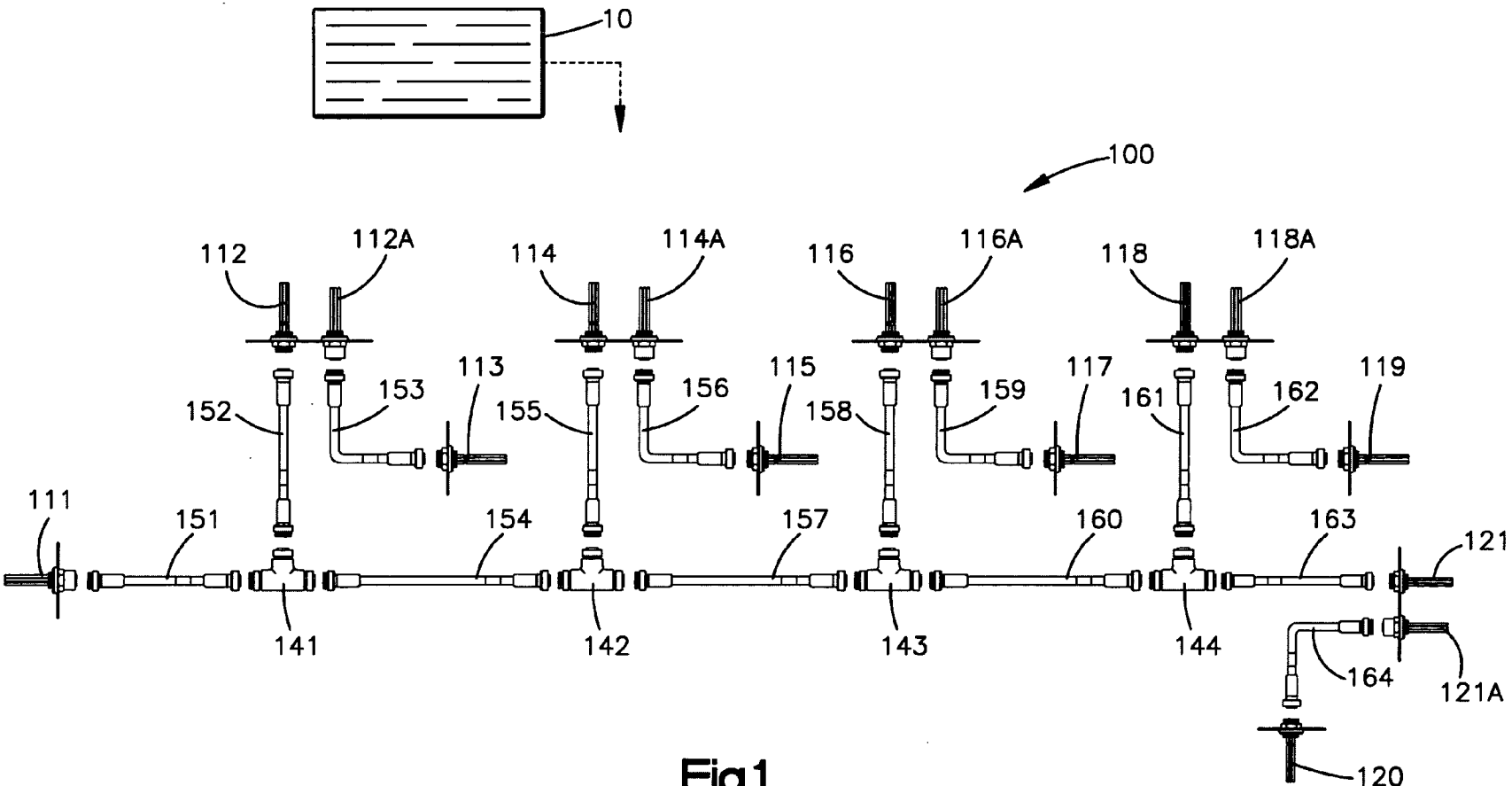
FIG. 1 is an example representation of an interconnectivity system in accordance with the present invention.

In FIG. 1, sixteen receptacles 111-121 of varying amperages are interconnected by the example system 100. Cable (100 AMP) 151 interconnects receptacle (100 AMP) 111 and the tee (100/100/100 AMP) 141. Cable (100 AMP) 152 interconnects receptacle (100 AMP) 112 and tee (100/100/100 AMP) 141. Other electrical equipment not part of this invention is used to control the flow of electricity between receptacles 112 and 112A. Cable (100 AMP) 153 interconnects receptacle (100 AMP) 112A and receptacle (100 AMP) 113. Cable (100 AMP) 154 interconnects tee (100/100/100 AMP) 141 and tee (100/100/85 AMP) 142. Cable (85 AMP) 155 interconnects receptacle (85 AMP) 114 and tee (100/100/85 AMP) 142. Other electrical equipment not part of this invention is used to protect the 85 AMP conductors and to control the flow of electricity between receptacles 114 and 114A. Cable (85 AMP) 156 interconnects receptacle (85 AMP) 114A and receptacle (85 AMP) 115. Cable (100 AMP) 157 interconnects tee (100/100/85 AMP) 142 and tee (100/100/65 AMP) 143. Cable (65 AMP) 158 interconnects receptacle (65 AMP) 116 and tee (100/100/65 AMP) 143. Other electrical equipment not part of this invention is used to protect the 65 AMP conductors and to control the flow of electricity between receptacles 116 and 116A. Cable (65 AMP) 159 interconnects receptacle (65 AMP) 116A and receptacle (65 AMP) 117. Cable (100 AMP) 160 interconnects tee (100/100/65 AMP) 143 and (100/100/50 AMP) tee 144. Cable (50 AMP) 161 interconnects receptacle (50 AMP) 118 and tee (100/100/50 AMP) 144. Other electrical equipment not part of this invention is used to protect the 50 AMP conductors and to control the flow of electricity between receptacles 118 and 118A. Cable (50 AMP) 162 interconnects receptacle (50 AMP) 118A and receptacle (50 AMP) 119. Cable (100 AMP) 163 interconnects tee (100/100/50 AMP) 144 and receptacle (100 AMP) 121. Other electrical equipment not part of this invention is used to control the flow of electricity between receptacles 121 and 121A. Cable (100 AMP) 164 interconnects receptacle (100 AMP) 121A and receptacle (100 AMP) 120.

FIG. 1 may also represent sixteen receptacles 111-121 of varying amperages interconnected by another example system 100. Cable (85 AMP) 151 interconnects receptacle (85 AMP) 111 and the tee (85/85/85 AMP) 141. Cable (85 AMP) 152 interconnects receptacle (85 AMP) 112 and tee (85/85/85 AMP) 141. Other electrical equipment not part of this invention is used to control the flow of electricity between receptacles 112 and 112A. Cable (85 AMP) 153 interconnects receptacle (85 AMP) 112A and receptacle (85 AMP) 113. Cable (85 AMP) 154 interconnects tee (85/85/85 AMP) 141 and tee (85/85/65 AMP) 142. Cable (65 AMP) 155 interconnects receptacle (65 AMP) 114 and tee (85/85/65 AMP) 142. Other electrical equipment not part of this invention is used to protect the 65 AMP conductors and to control the flow of electricity between receptacles 114 and 114A. Cable (65 AMP) 156 interconnects receptacle (65 AMP) 114A and receptacle (65 AMP) 115. Cable (85 AMP) 157 interconnects tee (85/85/50 AMP) 142 and tee (85/85/50 AMP) 143. Cable (50 AMP) 158 interconnects receptacle (50 AMP) 116 and tee (85/85/50 AMP) 143. Other electrical equipment not part of this invention is used to protect the 50 AMP conductors and to control the flow of electricity between receptacles 116 and 116A. Cable (50 AMP) 159 interconnects receptacle (50 AMP) 116A and receptacle (50 AMP) 117. Cable (85 AMP) 160 interconnects tee (85/85/50 AMP) 143 and (85/85/30 AMP) tee 144. Cable (30 AMP) 161 interconnects receptacle (30 AMP) 118 and tee (85/85/30 AMP) 144. Other electrical equipment not part of this invention is used to protect the 30 AMP conductors and to control the flow of electricity between receptacles 118 and 118A. Cable (30 AMP) 162 interconnects receptacle (30 AMP) 118A and receptacle (30 AMP) 119. Cable (85 AMP) 163 interconnects tee (85/85/30 AMP) 144 and receptacle (85 AMP) 121. Other electrical equipment not part of this invention is used to control the flow of electricity between receptacles 121 and 121A. Cable (85 AMP) 164 interconnects receptacle (85 AMP) 121A and receptacle (85 AMP) 120.

FIG. 1 may furthermore also represent sixteen receptacles 111-121 of varying amperages interconnected by still another example system 100. Cable (65 AMP) 151 interconnects receptacle (65 AMP) 111 and the tee (65/65/65 AMP) 141. Cable (65 AMP) 152 interconnects receptacle (65 AMP) 112 and tee (65/65/65 AMP) 141. Other electrical equipment not part of this invention is used to control the flow of electricity between receptacles 112 and 112A. Cable (65 AMP) 153 interconnects receptacle (65 AMP) 112A and receptacle (65 AMP) 113. Cable (65 AMP) 154 interconnects tee (65/65/65 AMP) 141 and tee (65/65/50 AMP) 142. Cable (50 AMP) 155 interconnects receptacle (50 AMP) 114 and tee (65/65/50 AMP) 142. Other electrical equipment not part of this invention is used to protect the 50 AMP conductors and to control the flow of electricity between receptacles 114 and 114A. Cable (50 AMP) 156 interconnects receptacle (50 AMP) 114A and receptacle (50 AMP) 115. Cable (65 AMP) 157 interconnects tee (65/65/50 AMP) 142 and tee (65/65/30 AMP) 143. Cable (30 AMP) 158 interconnects receptacle (30 AMP) 116 and tee (65/65/30 AMP) 143. Other electrical equipment not part of this invention is used to protect the 30 AMP conductors and to control the flow of electricity between receptacles 116 and 116A. Cable (30 AMP) 159 interconnects receptacle (30 AMP) 116A and receptacle (30 AMP) 117. Cable (65 AMP) 160 interconnects tee (65/65/30 AMP) 143 and (65/65/20 AMP) tee 144. Cable (20 AMP) 161 interconnects receptacle (20 AMP) 118 and tee (65/65/20 AMP) 144. Other electrical equipment not part of this invention is used to protect the 20 AMP conductors and to control the flow of electricity between receptacles 118 and 118A. Cable (20 AMP) 162 interconnects receptacle (20 AMP) 118A and receptacle (20 AMP) 119. Cable (65 AMP) 163 interconnects tee (65/65/20 AMP) 144 and receptacle (65 AMP) 121. Other electrical equipment not part of this invention is used to control the flow of electricity between receptacles 121 and 121A. Cable (65 AMP) 164 interconnects receptacle (65 AMP) 121A and receptacle (65 AMP) 120.

FIG. 1 may yet and furthermore also represent sixteen receptacles 111-121 of varying amperages interconnected by still another example system 100. Cable (50 AMP) 151 interconnects receptacle (50 AMP) 111 and the tee (50/50/50 AMP) 141. Cable (50 AMP) 152 interconnects receptacle (50 AMP) 112 and tee (50/50/50 AMP) 141. Other electrical equipment not part of this invention is used to control the flow of electricity between receptacles 112 and 112A. Cable (50 AMP) 153 interconnects receptacle (50 AMP) 112A and receptacle (50 AMP) 113. Cable (50 AMP) 154 interconnects tee (50/50/50 AMP) 141 and tee (50/50/30 AMP) 142. Cable (50 AMP) 155 interconnects receptacle (30 AMP) 114 and tee (50/50/30 AMP) 142. Other electrical equipment not part of this invention is used to protect the 30 AMP conductors and to control the flow of electricity between receptacles 114 and 114A. Cable (30 AMP) 156 interconnects receptacle (30 AMP) 114A and receptacle (30 AMP) 115. Cable (50 AMP) 157 interconnects tee (50/50/30 AMP) 142 and tee (50/50/20 AMP) 143. Cable (20 AMP) 158 interconnects receptacle (20 AMP) 116 and tee (50/50/20 AMP) 143. Other electrical equipment not part of this invention is used to protect the 20 AMP conductors and to control the flow of electricity between receptacles 116 and 116A. Cable (20 AMP) 159 interconnects receptacle (20 AMP) 116A and receptacle (20 AMP) 117. Cable (50 AMP) 160 interconnects tee (50/50/20 AMP) 143 and (50/50/10 AMP) tee 144. Cable (10 AMP) 161 interconnects receptacle (10 AMP) 118 and tee (50/50/10 AMP) 144. Other electrical equipment not part of this invention is used to protect the 10 AMP conductors and to control the flow of electricity between receptacles 118 and 118A. Cable (20 AMP) 162 interconnects receptacle (10 AMP) 118A and receptacle (10 AMP) 119. Cable (50 AMP) 163 interconnects tee (50/50/20 AMP) 144 and receptacle (50 AMP) 121. Other electrical equipment not part of this invention is used to control the flow of electricity between receptacles 121 and 121A. Cable (50 AMP) 164 interconnects receptacle (50 AMP) 121A and receptacle (50 AMP) 120.

In FIG. 1, may further represent thirteen receptacles 111-121 of varying amperages interconnected by the example system 100. Cable (30 AMP) 151 interconnects receptacle (30 AMP) 111 and the tee (30/30/30 AMP) 141. Cable (30 AMP) 152 interconnects receptacle (30 AMP) 112 and tee (30/30/30 AMP) 141. Other electrical equipment not part of this invention is used to control the flow of electricity between receptacles 112 and 112A. Cable (30 AMP) 153 interconnects receptacle (30 AMP) 112A and receptacle (30 AMP) 113. Cable (30 AMP) 154 interconnects tee (30/30/30 AMP) 141 and tee (30/30/20 AMP) 142. Cable (20 AMP) 155 interconnects receptacle (20 AMP) 114 and tee (30/30/20 AMP) 142. Other electrical equipment not part of this invention is used to protect the 20 AMP conductors and to control the flow of electricity between receptacles 114 and 114A. Cable (20 AMP) 156 interconnects receptacle (20 AMP) 114A and receptacle (20 AMP) 115. Cable (30 AMP) 157 interconnects tee (30/30/20 AMP) 142 and tee (30/30/10 AMP) 143. Cable (10 AMP) 158 interconnects receptacle (10 AMP) 116 and tee (30/30/10 AMP) 143. Other electrical equipment not part of this invention is used to protect the 10 AMP conductors and to control the flow of electricity between receptacles 116 and 116A. Cable (10 AMP) 159 interconnects receptacle (10 AMP) 116A and receptacle (10 AMP) 117. Cable (30 AMP) 163 interconnects tee (50/50/10 AMP) 143 and receptacle (30 AMP) 121. Other electrical equipment not part of this invention is used to control the flow of electricity between receptacles 121 and 121A. Cable (30 AMP) 164 interconnects receptacle (30 AMP) 121A and receptacle (30 AMP) 120.

FIG. 1, may still further represent ten receptacles 111-121 of varying amperages interconnected by the example system 100. Cable (20 AMP) 151 interconnects receptacle (20 AMP) 111 and the tee (20/20/20 AMP) 141. Cable (20 AMP) 152 interconnects receptacle (20 AMP) 112 and tee (20/20/20 AMP) 141. Other electrical equipment not part of this invention is used to control the flow of electricity between receptacles 112 and 112A. Cable (20 AMP) 153 interconnects receptacle (20 AMP) 112A and receptacle (20 AMP) 113. Cable (20 AMP) 154 interconnects tee (20/20/20 AMP) 141 and tee (20/20/10 AMP) 142. Cable (10 AMP) 155 interconnects receptacle (10 AMP) 114 and tee (20/20/10 AMP) 142. Other electrical equipment not part of this invention is used to protect the 10 AMP conductors and to control the flow of electricity between receptacles 114 and 114A. Cable (10 AMP) 156 interconnects receptacle (10 AMP) 114A and receptacle (10 AMP) 115. Cable (10 AMP) 157 interconnects tee (20/20/10 AMP) 142 receptacle (20 AMP) 121. Other electrical equipment not part of this invention is used to control the flow of electricity between receptacles 121 and 121A. Cable (20 AMP) 164 interconnects receptacle (20 AMP) 121A and receptacle (20 AMP) 120.

FIG. 1 may yet further represent seven receptacles 111-121 of varying amperages interconnected by the example system 100. Cable (10 AMP) 151 interconnects receptacle (10 AMP) 111 and the tee (10/10/10 AMP) 141. Cable (10 AMP) 152 interconnects receptacle (10 AMP) 112 and tee (10/10/10 AMP) 141. Other electrical equipment not part of this invention is used to control the flow of electricity between receptacles 112 and 112A. Cable (20 AMP) 153 interconnects receptacle (10 AMP) 112A and receptacle (10 AMP) 113. Cable (10 AMP) 154 interconnects tee (10/10/10 AMP) 141 and receptacle (10 AMP) 121. Other electrical equipment not part of this invention is used to control the flow of electricity between receptacles 121 and 121A. Cable (10 AMP) 164 interconnects receptacle (10 AMP) 121A and receptacle (10 AMP) 120.

Figure 2:
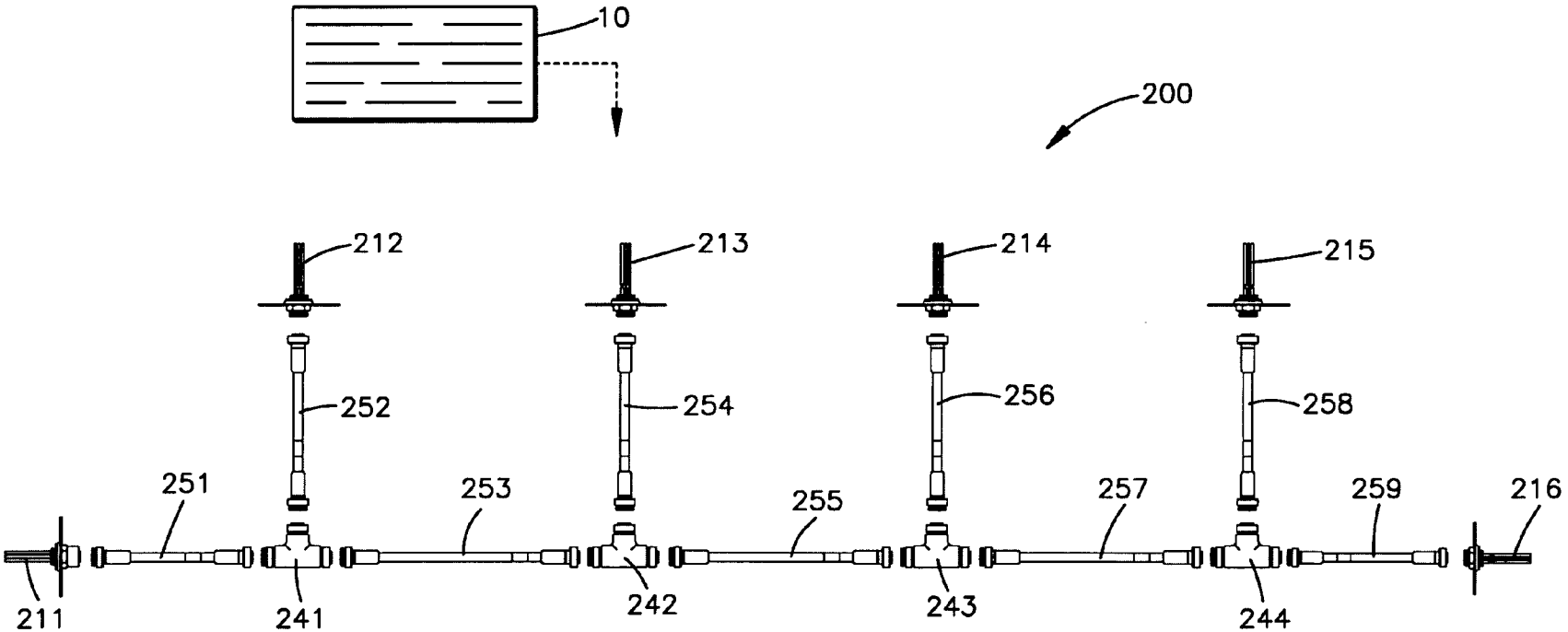
FIG. 2 is another example representation of an interconnectivity system in accordance with the present invention.

In FIG. 2, six receptacles 211-216 of varying amperages are interconnected by the example system 200 in which a series of components of a single common nominal ampacity rating of 100, 85, 65, 50, 30, 20 or 10 AMP, or of hybrid ampacity for power and/or control, and/or signal and/or communications type is applied. Cable (100, 85, 65, 50, 30, 20 or 10 AMP or of hybrid ampacity for power and/or control, and/or signal and/or communications type) 251 interconnects receptacle (100, 85, 65, 50, 30, 20 or 10 AMP or of hybrid ampacity for power and/or control, and/or signal and/or communications type) 211 and the tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 241. Cable (100, 85, 65, 50, 30, 20 or 10 AMP or of hybrid ampacity for power and/or control, and/or signal and/or communications type) 252 interconnects receptacle (100, 85, 65, 50, 30, 20 or 10 AMP or of hybrid ampacity for power and/or control, and/or signal and/or communications type) 212 and tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 241. Cable (100, 85, 65, 50, 30, 20 or 10 AMP or of hybrid ampacity for power and/or control, and/or signal and/or communications type) 253 interconnects tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 241 and tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 242. Cable (100, 85, 65, 50, 30, 20 or 10 AMP or of hybrid ampacity for power and/or control, and/or signal and/or communications type) 254 interconnects receptacle (100, 85, 65, 50, 30, 20 or 10 AMP or of hybrid ampacity for power and/or control, and/or signal and/or communications type) 213 and tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 242. Cable (100, 85, 65, 50, 30, 20 or 10 AMP or of hybrid ampacity for power and/or control, and/or signal and/or communications type) 255 interconnects tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 242 and tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type AMP) 243. Cable (100, 85, 65, 50, 30, 20 or 10 AMP or of hybrid ampacity for power and/or control, and/or signal and/or communications type) 256 interconnects receptacle (100, 85, 65, 50, 30, 20 or 10 AMP or of hybrid ampacity for power and/or control, and/or signal and/or communications type) 214 and tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 243. Cable (100, 85, 65, 50, 30, 20 or 10 AMP or of hybrid ampacity for power and/or control, and/or signal and/or communications type) 257 interconnects tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 243 and tee (100, 85, 65, 50, 30, 20 or 10 AMP or of hybrid ampacity for power and/or control, and/or signal and/or communications type/100, 85, 65, 50, 30, 20 or 10 AMP/or of hybrid ampacity for power and/or control, and/or signal and/or communications type 100, 85, 65, 50, 30, 20 or 10 AMP or of hybrid ampacity for power and/or control, and/or signal and/or communications type) 244. Cable (100, 85, 65, 50, 30, 20 or 10 AMP or of hybrid ampacity for power and/or control, and/or signal and/or communications type) 258 interconnects receptacle (100, 85, 65, 50, 30, 20 or 10 AMP or of hybrid ampacity for power and/or control, and/or signal and/or communications type) 215 and tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 244. Cable (100, 85, 65, 50, 30, 20 or 10 AMP or of hybrid ampacity for power and/or control, and/or signal and/or communications type) 259 interconnects tee (100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type/100, 85, 65, 50, 30, 20 or 10 AMP or of hybrid ampacity for power and/or control, and/or signal and/or communications type) 244 and receptacle (100, 85, 65, 50, 30, 20 or 10 AMP or of hybrid ampacity for power and/or control, and/or signal and/or communications type) 216.

Figure 3:
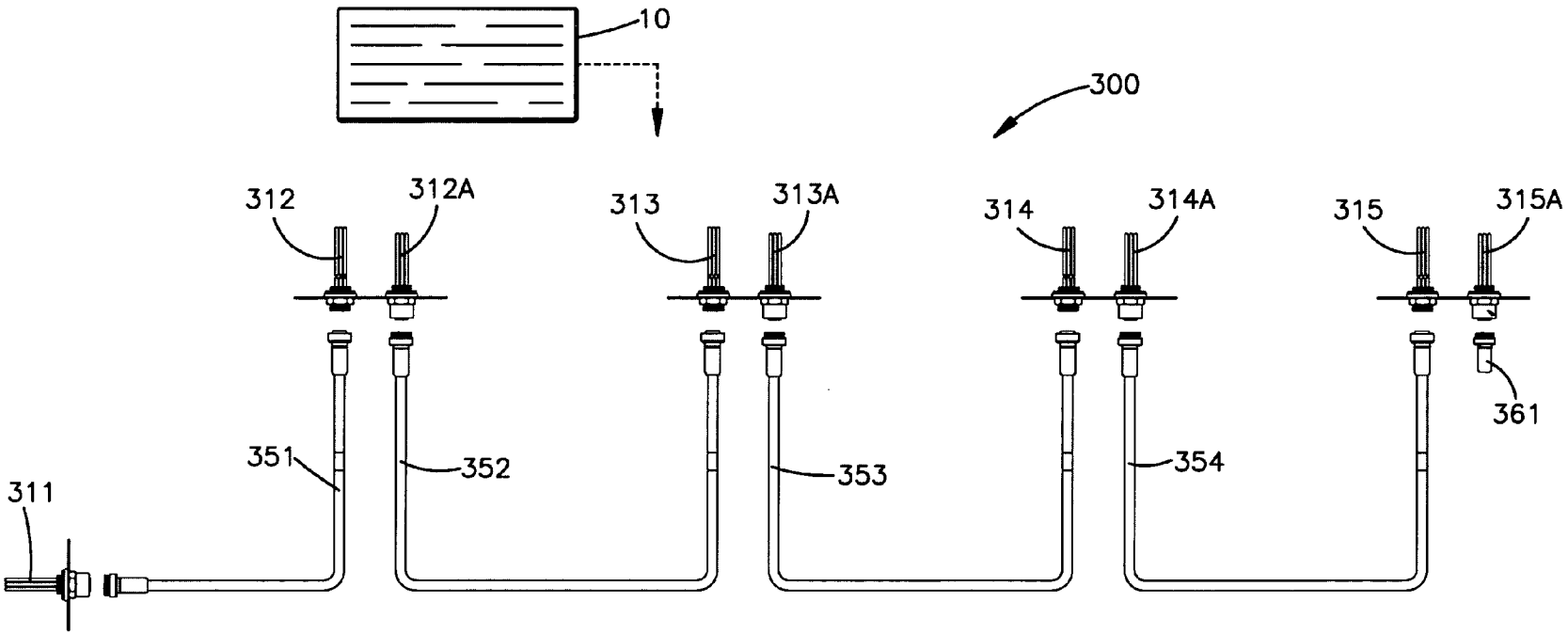
FIG. 3 is still another example representation of an interconnectivity system in accordance with the present invention.

In FIG. 3, nine receptacles 311-215 of varying amperages are interconnected by the example system 300 in which a series of components of a single common nominal ampacity rating of 100, 85, 65, 50, 30, 20 or 10 AMP, or of hybrid ampacity for power and/or control, and/or signal and/or communications type, is applied. Cable (100, 85, 65, 50, 30, 20 or 10 AMP or of hybrid ampacity for power and/or control, and/or signal and/or communications type) 351 interconnects receptacle (100, 85, 65, 50, 30, 20 or 10 AMP or of hybrid ampacity for power and/or control, and/or signal and/or communications type) 311 and receptacle (100, 85, 65, 50, 30, 20 or 10 AMP or of hybrid ampacity for power and/or control, and/or signal and/or communications type) 312. Other electrical equipment not part of this invention is used to control the flow of electricity between receptacles 312 and 312A. Cable (100, 85, 65, 50, 30, 20 or 10 AMP or of hybrid ampacity for power and/or control, and/or signal and/or communications type) 352 interconnects receptacle (100, 85, 65, 50, 30, 20 or 10 AMP or of hybrid ampacity for power and/or control, and/or signal and/or communications type) 312A and receptacle (100, 85, 65, 50, 30, 20 or 10 AMP or of hybrid ampacity for power and/or control, and/or signal and/or communications type) 313. Other electrical equipment not part of this invention is used to control the flow of electricity between receptacles 313 and 313A. Cable (100, 85, 65, 50, 30, 20 or 10 AMP or of hybrid ampacity for power and/or control, and/or signal and/or communications type) 353 interconnects receptacle (100, 85, 65, 50, 30, 20 or 10 AMP or of hybrid ampacity for power and/or control, and/or signal and/or communications type) 313A and receptacle (100, 85, 65, 50, 30, 20 or 10 AMP or of hybrid ampacity for power and/or control, and/or signal and/or communications type) 314. Other electrical equipment not part of this invention is used to control the flow of electricity between receptacles 314 and 314A. Cable (100, 85, 65, 50, 30, 20 or 10 AMP or of hybrid ampacity for power and/or control, and/or signal and/or communications type) 354 interconnects receptacle (100, 85, 65, 50, 30, 20 or 10 AMP or of hybrid ampacity for power and/or control, and/or signal and/or communications type) 314A and receptacle (100, 85, 65, 50, 30, 20 or 10 AMP or of hybrid ampacity for power and/or control, and/or signal and/or communications type) 315. Other electrical equipment not part of this invention is used to control the flow of electricity between receptacles 314 and 314A. Terminator 361 (of hybrid ampacity for power and/or control, and/or signal and/or communications type) houses resistors, jumpers and the like as may be required by the application and interconnects with receptacle (when of hybrid ampacity for power and/or control, and/or signal and/or communications type) 315A.

Figure 4:
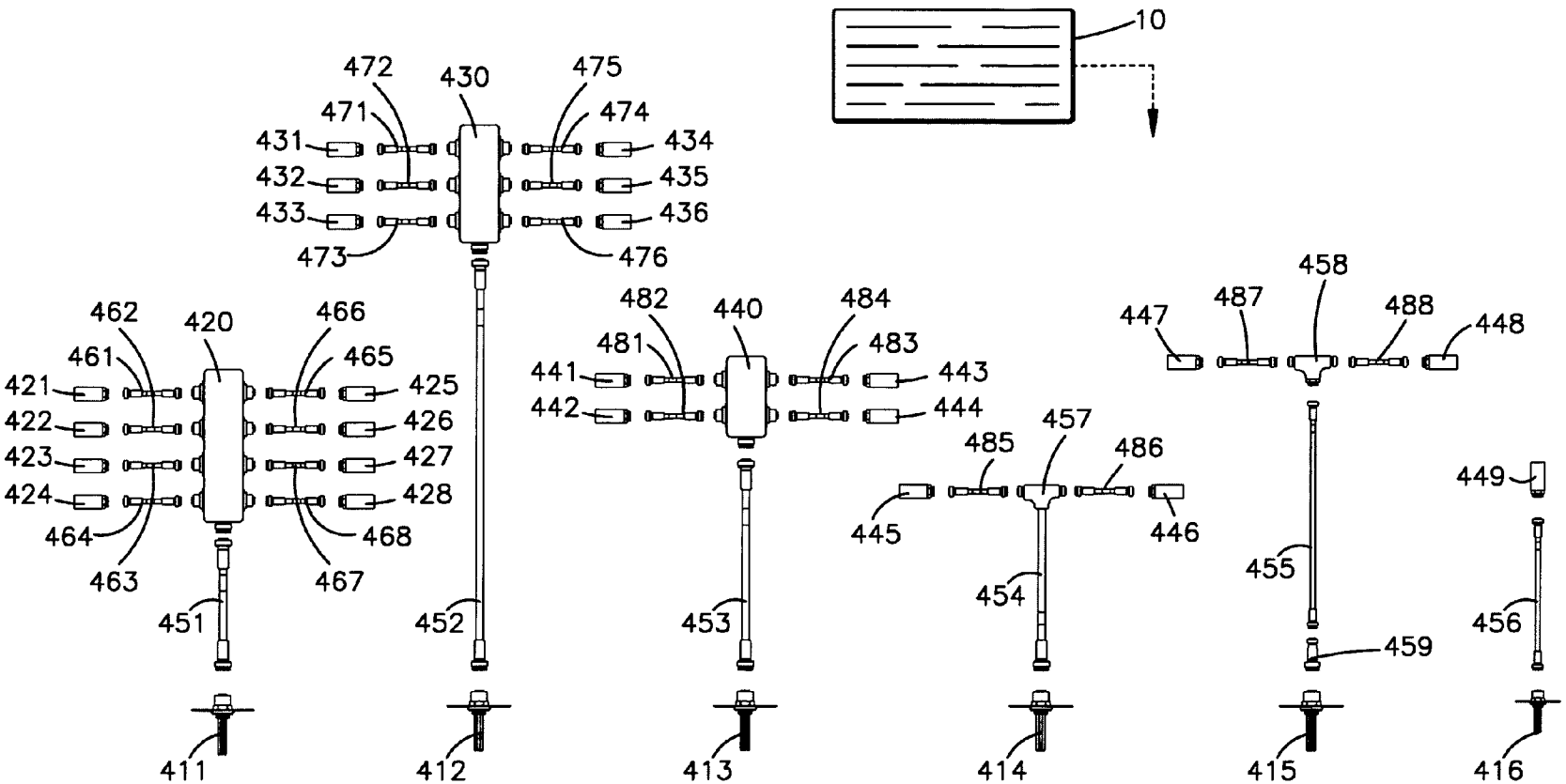
FIG. 4 is yet another example representation of an interconnectivity system in accordance with the present invention.

In FIG. 4, six receptacles 411-416 and twenty-three input/output devices 421-428, 431-436, 441-449 of nominal 3 ampere rating are interconnected by the example system 400. Cable 451 interconnects receptacle (3 AMP) 411 and multi-port adapter (3/3 AMP) 420. Cable (3 AMP) 452 interconnects receptacle (3 AMP) 412 and multi-port adapter (3/3 AMP) 430. Cable (3 AMP) 453 interconnects receptacle (3 AMP) 413 and multi-port adapter (3/3 AMP) 440. Cable (3 AMP) 454 interconnects receptacle (3 AMP) 414 and tee (3/3/3 AMP) 457. Pass-thru (3 AMP) 459 interconnects receptacle (3 AMP) 415 and cable (3 AMP) 455. Cable (3 AMP) 455 interconnects pass-thru (3 AMP) 459 and tee (3/3/3 AMP) 458. Cable (3 AMP) 456 interconnects receptacle (3 AMP) 416 and input/output device (3 AMP) 449.

Cable (3 AMP) 461 interconnects multi-port adapter 420 and input/output device 421. Cable (3 AMP) 462 interconnects multi-port adapter 420 and input/output device 422. Cable (3 AMP) 463 interconnects multi-port adapter 420 and input/output device 423. Cable (3 AMP) 464 interconnects multi-port adapter 420 and input/output device 424. Cable (3 AMP) 465 interconnects multi-port adapter 420 and input/output device 425. Cable (3 AMP) 466 interconnects multi-port adapter 420 and input/output device 426. Cable (3 AMP) 467 interconnects multi-port adapter 420 and input/output device 427. Cable (3 AMP) 468 interconnects multi-port adapter 420 and input/output device 428.

Cable (3 AMP) 471 interconnects multi-port adapter 430 and input/output device 431. Cable (3 AMP) 472 interconnects multi-port adapter 430 and input/output device 432. Cable (3 AMP) 473 interconnects multi-port adapter 430 and input/output device 433. Cable (3 AMP) 474 interconnects multi-port adapter 430 and input/output device 434. Cable (3 AMP) 475 interconnects multi-port adapter 430 and input/output device 435. Cable (3 AMP) 476 interconnects multi-port adapter 430 and input/output device 436.

Cable (3 AMP) 481 interconnects multi-port adapter 440 and input/output device 441. Cable (3 AMP) 482 interconnects multi-port adapter 440 and input/output device 442. Cable (3 AMP) 483 interconnects multi-port adapter 440 and input/output device 443. Cable (3 AMP) 484 interconnects multi-port adapter 440 and input/output device 444.

Cable (3 AMP) 485 interconnects input/output device 445 and tee 457. Cable 486 (3 AMP) interconnects input/output device 446 and tee 457. Cable (3 AMP) 487 interconnects input/output device 447 and tee 458. Cable (3 AMP) 488 interconnects input/output device 448 and tee 458.

Figure 5:
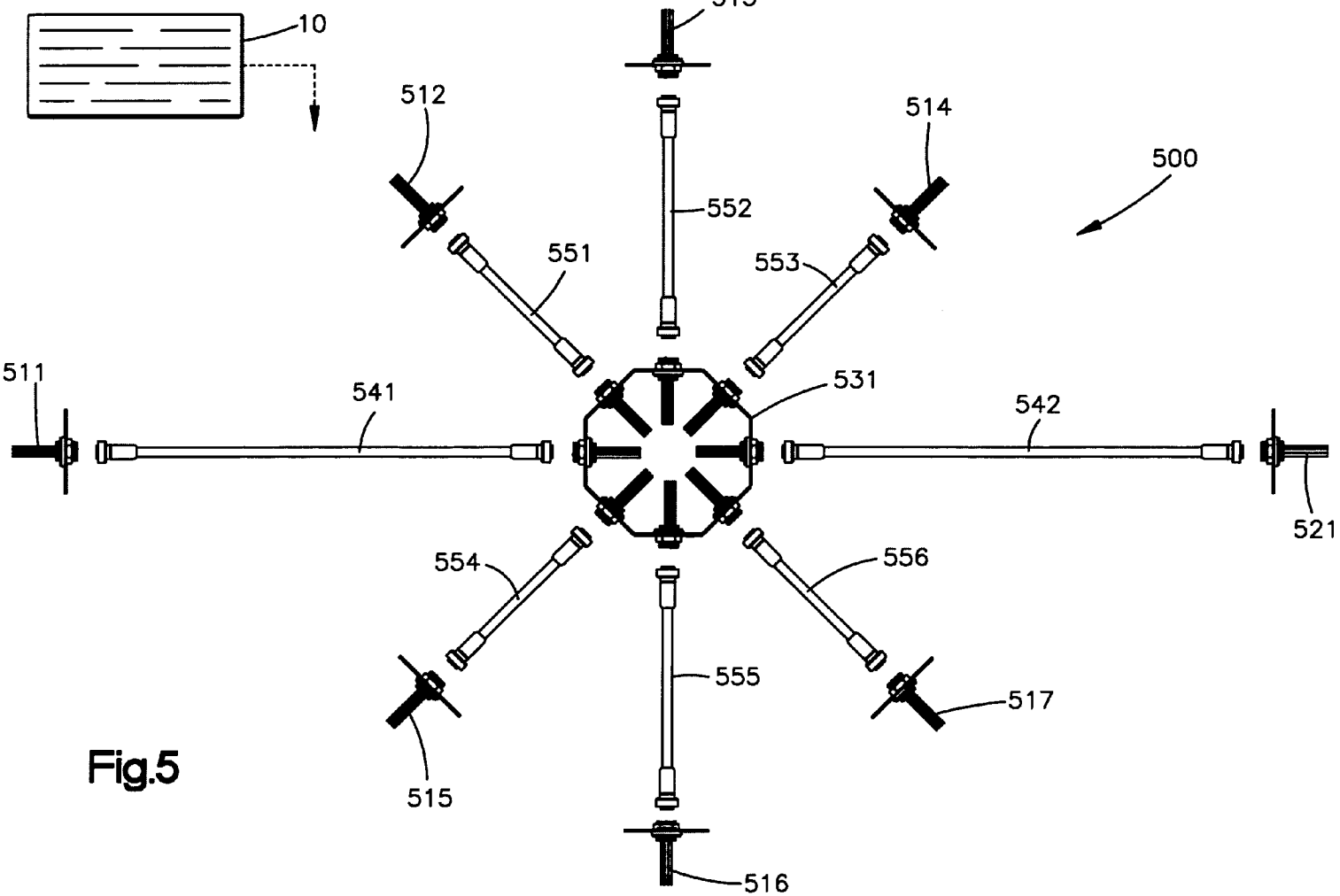
FIG. 5 is still another example representation of an interconnectivity system in accordance with the present invention.

FIG. 5 may represent, sixteen receptacles 511-521 of varying amperages are interconnected by the example system 500 in which a series of components of a single common nominal ampacity rating of 100, 85, 65, 50, 30, 20 or 10 or of hybrid ampacity for power and/or control, and/or signal and/or communications type is applied. Cable (100, 85, 65, 50, 30, 20 or 10 AMP or of hybrid ampacity for power and/or control, and/or signal and/or communications type) 541 interconnects receptacle (100, 85, 65, 50, 30, 20 or 10 AMP or of hybrid ampacity for power and/or control, and/or signal and/or communications type) 511 and receptacle convergence (100, 85, 65, 50, 30, 20 or 10 AMP or of hybrid ampacity for power and/or control, and/or signal and/or communications type) 531. Cable (100, 85, 65, 50, 30, 20 or 10 AMP or of hybrid ampacity for power and/or control, and/or signal and/or communications type) 542 interconnects receptacle (100, 85, 65, 50, 30, 20 or 10 AMP or of hybrid ampacity for power and/or control, and/or signal and/or communications type) 521 and receptacle convergence (100, 85, 65, 50, 30, 20 or 10 AMP or of hybrid ampacity for power and/or control, and/or signal and/or communications type) 531. Cable (100, 85, 65, 50, 30, 20 or 10 AMP or of hybrid ampacity for power and/or control, and/or signal and/or communications type) 551 interconnects receptacle convergence (100, 85, 65, 50, 30, 20 or 10 AMP or of hybrid ampacity for power and/or control, and/or signal and/or communications type) 531 and receptacle (100, 85, 65, 50, 30, 20 or 10 AMP or of hybrid ampacity for power and/or control, and/or signal and/or communications type) 512. Cable (100, 85, 65, 50, 30, 20 or 10 AMP or of hybrid ampacity for power and/or control, and/or signal and/or communications type) 552 interconnects receptacle convergence (100, 85, 65, 50, 30, 20 or 10 AMP or of hybrid ampacity for power and/or control, and/or signal and/or communications type) 531 and receptacle (100, 85, 65, 50, 30, 20 or 10 AMP or of hybrid ampacity for power and/or control, and/or signal and/or communications type) 513. Cable (100, 85, 65, 50, 30, 20 or 10 AMP or of hybrid ampacity for power and/or control, and/or signal and/or communications type) 553 interconnects receptacle convergence (100, 85, 65, 50, 30, 20 or 10 AMP or of hybrid ampacity for power and/or control, and/or signal and/or communications type) 531 and receptacle (100, 85, 65, 50, 30, 20 or 10 AMP or of hybrid ampacity for power and/or control, and/or signal and/or communications type) 514. Cable (100, 85, 65, 50, 30, 20 or 10 AMP or of hybrid ampacity for power and/or control, and/or signal and/or communications type) 554 interconnects receptacle convergence (100, 85, 65, 50, 30, 20 or 10 AMP or of hybrid ampacity for power and/or control, and/or signal and/or communications type) 531 and receptacle (100, 85, 65, 50, 30, 20 or 10 AMP or of hybrid ampacity for power and/or control, and/or signal and/or communications type) 515. Cable (100, 85, 65, 50, 30, 20 or 10 AMP or of hybrid ampacity for power and/or control, and/or signal and/or communications type) 555 interconnects receptacle convergence (100, 85, 65, 50, 30, 20 or 10 AMP or of hybrid ampacity for power and/or control, and/or signal and/or communications type) 531 and receptacle (100, 85, 65, 50, 30, 20 or 10 AMP or of hybrid ampacity for power and/or control, and/or signal and/or communications type) 516. Cable (100, 85, 65, 50, 30, 20 or 10 AMP or of hybrid ampacity for power and/or control, and/or signal and/or communications type) 556 interconnects receptacle convergence (100, 85, 65, 50, 30, 20 or 10 AMP or of hybrid ampacity for power and/or control, and/or signal and/or communications type) 531 and receptacle (100, 85, 65, 50, 30, 20 or 10 AMP or of hybrid ampacity for power and/or control, and/or signal and/or communications type) 517.

Figure 6:
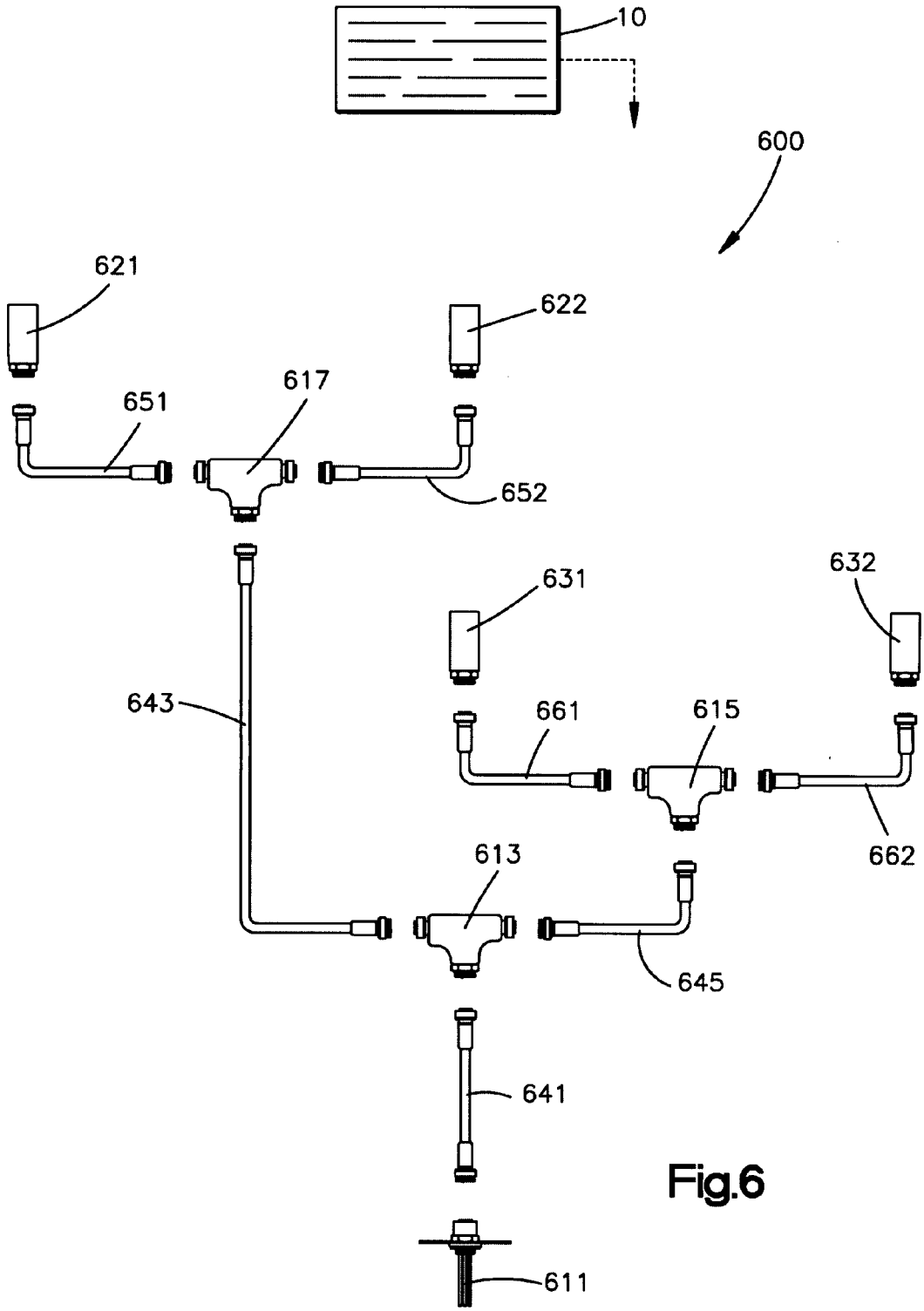
FIG. 6 is yet another example representation of an interconnectivity system in accordance with the present invention.

In FIG. 6, one receptacle 611 and four input/output devices 621-632 of nominal 3 amperages may be interconnected by the example system 600. Cable (3 AMP) 641 interconnects receptacle (3 AMP) 611 and tee (3/3/3 AMP) 613. Cable (3 AMP) 643 interconnects tee (3/3/3 AMP) 613 and tee (3/3/3 AMP) 617. Cable (3 AMP) 651 interconnects tee (3/3/3 AMP) 617 and input/output device 621. Cable (3 AMP) 652 interconnects tee (3/3/3 AMP) 617 and input/output device 622.

Cable (3 AMP) 645 interconnects tee (3/3/3 AMP) 613 and tee (3/3/3 AMP) 615. Cable (3 AMP) 661 interconnects tee (3/3/3 AMP) 615 and input/output device 631. Cable (3 AMP) 662 interconnects tee (3/3/3 AMP) 615 and input/output device 632.

The system performance criteria and specifications are based on a documented real world system application that has been successfully implemented. Industrial automation and material handling program teams, inclusive of system and industrial engineers, of a US government agency establish the initial high-level criteria and specifications. System engineering and obligation fulfillment teams establish further lower level criteria. A safe, robust, total performance, total quality system implementation executed in the shortest possible time by the lowest possible skill set at the lowest possible cost is expected. Superior cost performance relative to alternative interconnectivity solutions is expected. The system is the net interconnectivity product.

System, electrical, test, logistical support, and safety engineering principles may be applied to the system in order to establish and document the necessary system tests and validation processes. Test and validation has been performed on real world applications that progress through an operational system that is inclusive of a series of design reviews: preliminary concept, critical, final, and revision.

The theoretical solution is then tested and validated through a series of implementations inclusive of: laboratory, prototype, first article, and production. Compliance with the applicable safety related consensus standards and electrical codes is established.

System and electrical engineering principles are applied to the system in order to establish a series of all user-friendly methods and procedures. The objective is to have a simple, easy to use interconnectivity system that enables the greatest number of people in the shortest possible time relative to conventional interconnectivity solutions.

Electrical, mechanical, and materials engineering principles may be applied to the system in order to ensure an absolute performance in the field that stands the test of time. System, electrical, mechanical, manufacturing, and quality engineering principles may be applied to the system technical data in order to ensure the repeatability of component manufacture and a total quality interconnectivity system.

Electrical, mechanical, test, and quality engineering principles may be applied to the system component test and validation in order to ensure component performance in the integrated interconnectivity system. System engineering and acquisition principles may be applied to the system in order to ensure a serviceable and viable solution in the marketplace. Component availability and logistical performance requirements may also be established.

System and electrical engineering principles may further be applied to the system implementation tools. At the application design level, "expert" methodology may be established so as to enable the lowest possible skill set to identify an application's interconnectivity solution in the shortest possible time without a high degree of complication. At the physical implementation level, the system is such that in the worst-case only standard, hand tools are required, and in the best case, simply the hands are required.

System, electrical, mechanical, and logistical support engineering principles may be applied to the system in order to create a user-friendly interconnectivity system that may be installed in the shortest possible time by the lowest possible skill set without the need for the extensive training required by conventional interconnectivity solutions. Electrical engineering principles applied to the system establish third party inspection support documentation, which facilitates the acceptance of the interconnectivity solution in divergent geographical markets.

With the total system interconnectivity solution designed and validated under the auspices of well defined and specified system engineering processes, a smoother, less timely, less costly, more robust interconnectivity implementation may be effected relative to conventional methods. The system allows a single source of supply to be a single point of contact for an interconnectivity system solution—for all stakeholders. The system allows a single point of contact for all interconnectivity system solution technologies, which thereby spans all divergent, existing, marketplace profit centers. The inherent efficiencies therein serve to create a highly desirable system that may compete very profitably with conventional interconnectivity options.

There are no more user friendly, economical, seamless, and safer interconnectivity system than that of the system in accordance with the present invention. Nor do conventional interconnectivity solutions offer a single point solution, multiple profit center, and marketplace opportunity.

The system in accordance with the present invention is a consensus standard compatible. The system is a compliant, user friendly, pre-manufactured, electrical interconnectivity system. The system offers the utmost in implementation flexibility, modularity, and scalability at the lowest possible end-user cost relative to the conventional solutions. The system is inclusive of a series of methodologies and predefined assemblies that allow electrical power, control, signal, and data interconnectivity circuits to be installed, altered, and maintained, in the shortest possible time relative to conventional interconnectivity systems. The system ensures a total quality field implementation that is absolutely repeatable regardless of implementer expertise, thereby serving to eliminate schedule slippage and cost overruns.

As shown in the figure, element 10 represents a physical source of components from which all of the other elements originate and first through sixth numbers of devices may be arbitrary designations for groupings of devices. For example, in FIG. 1, receptacles 111 and 112 may be a first number of devices, receptacles 112A and 113 may be a second number of devices, receptacles 114A and 115 may be a third number of devices, receptacles 116A and 117 may be a fourth number of devices, receptacles 118A and 119 may be a fifth number of devices, and receptacles 121A and 120 may be a sixth number of devices.

Although the invention has been described in conjunction with the example embodiment, it is to be appreciated that various modifications may be made without departing from the spirit and scope of the invention as defined by the appended claims.

I claim:

1. A system for interconnecting a plurality of devices for electrical power, control, signal, and data transmission, said system comprising:

a single physical source of components providing complete interconnectivity between a first number of devices, said components having hybrid capacity for power, control, signal, and communication, said single source of components providing complete interconnectivity between the first number of devices and a second number of devices augmenting the first number of devices, at least one of said first number of devices and said second number of devices having an octagonal configuration with eight connection points for eight of said components, at least one other of said first number of devices and said second number of devices having a tee configuration with three connection points for three of said components, each component of said single source of components supporting a 100 ampere load.

2. The system as set forth in claim 1 wherein said single source of components provides complete interconnectivity between the first and second numbers of devices and a third number of devices augmenting the first and second numbers of devices.

3. The system as set forth in claim 2 wherein said single source of components provides complete interconnectivity between the first, second, and third numbers of devices and a fourth number of devices augmenting the first, second, and third numbers of devices.

4. The system as set forth in claim 3 wherein said single source of components provides complete interconnectivity between the first, second, third, and fourth numbers of devices and a fifth number of devices augmenting the first, second, third, and fourth numbers of devices.

5. The system as set forth in claim 4 wherein said single source of components provides complete interconnectivity between the first, second, third, fourth, and fifth numbers of devices and a sixth number of devices augmenting the first, second, third, fourth, and fifth numbers of devices.

* * * * *